US008515320B2

(12) United States Patent
Sakurai

(10) Patent No.: US 8,515,320 B2
(45) Date of Patent: Aug. 20, 2013

(54) DEVELOPING DEVICE, PROCESS UNIT AND IMAGE FORMING APPARATUS

(75) Inventor: Hideto Sakurai, Setagaya-ku (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 81 days.

(21) Appl. No.: 12/967,408

(22) Filed: Dec. 14, 2010

(65) Prior Publication Data

US 2011/0150538 A1 Jun. 23, 2011

(30) Foreign Application Priority Data

Dec. 17, 2009 (JP) ..... 2009-286043

(51) Int. Cl.
*G03G 15/09* (2006.01)

(52) U.S. Cl.
USPC ..... 399/277

(58) Field of Classification Search
USPC ..... 399/277
See application file for complete search history.

(56) References Cited

U.S. PATENT DOCUMENTS 8,086,153 B2 * 12/2011 Jeon et al. ..... 399/282
2009/0274489 A1 * 11/2009 Jeon et al. ..... 399/277

FOREIGN PATENT DOCUMENTS

JP 7-020715 A 1/1995

OTHER PUBLICATIONS

Machine translation of Yoshiharu (JP 07-020715 A). Pub date: Jan. 24, 1995.*

* cited by examiner

*Primary Examiner* — Walter L Lindsay, Jr.
*Assistant Examiner* — Frederick Wenderoth
(74) *Attorney, Agent, or Firm* — Buchanan Ingersoll & Rooney PC

(57) ABSTRACT

Provided is a developing device for developing an electrostatic latent image on an image carrier, the developing device comprising: a housing having an opening; a developing sleeve facing the image carrier through the opening; a magnet roller encased in the developing sleeve and having magnetic poles including (i) a first magnetic pole having a strongest magnetic force of all the magnetic poles and (ii) a second magnetic pole having a magnetic force equal to or larger than a predetermined value and being different from the first magnetic pole; and a positioning member operable to allow the magnet roller to rotate together with the developing sleeve when the magnet roller is in a first rotational position where the first or the second magnetic pole faces an edge of the opening located downstream in a transfer direction of a two-component developer, and to inhibit the rotation of the magnet roller when the magnet roller is in a second rotational position where the first magnetic pole is closest to the image carrier.

20 Claims, 11 Drawing Sheets

DEVELOPING DEVICE, PROCESS UNIT AND IMAGE FORMING APPARATUS

This application is based on application No. 2009-286043 filed in Japan, the content of which is hereby incorporated by reference.

BACKGROUND OF THE INVENTION (1) Field of the Invention

The present invention relates to a developing device for developing an electrostatic latent image on an image carrier such as a photoreceptor, with use of a two-component developer, a process unit having the developing device and the image carrier, and an image forming apparatus having the process unit.

(2) Related Art

There have been image forming apparatuses, such as printers and copiers, that form full-color images with use of the toners of yellow (Y), magenta (M), cyan (C) and black (K), in an electrophotographic method. Such image forming apparatuses are provided with process units for forming toner images of the colors Y, M, C, and K. In general, the toner images of the respective colors formed by the process units are transferred onto an intermediate transfer belt, and thereafter transferred and fixed onto a recording sheet.

Each process unit includes a photosensitive drum that is an image carrier, a charging device, a developing device, and so on. The photosensitive drum rotates around its central axis. The charging device charges the photosensitive drum to form an electrostatic latent image thereon. The developing device develops the electrostatic latent image on the photosensitive drum with use of the toners of different colors. The developing device may develop the electrostatic latent image with use of only the toners of the colors Y, M, C, and K, or with use of a two-component developer including toner and magnetic carriers.

In the case of using the two-component developer, the developing device is provided with a developing roller which includes a housing, a developing sleeve, and a magnet roller. The housing contains toner and magnetic carriers. The developing sleeve has a cylindrical shape, and is arranged facing the photosensitive drum through an opening of the housing. The magnet roller has a columnar shape, and is fixed inside the developing sleeve so as to be coaxial therewith. The magnet roller is provided with a plurality of magnetic poles arranged along a circumferential direction thereof.

The developing sleeve is rotated to develop the electrostatic latent image on the photosensitive drum. As a result, on an outer circumferential surface of the developing sleeve, the carriers form a magnetic brush by a magnetic force of the magnetic poles in the magnet roller. With this magnetic brush, the toner in the housing is transferred. The toner transferred on the outer circumferential surface of the developing sleeve adheres to the electrostatic latent image on the photosensitive drum, at a position closest to the photosensitive drum. In this way, the electrostatic latent image on the photosensitive drum is developed.

Regarding an image forming apparatus including the process units that have the developing devices using the two-component developer, there is a demand for reducing the size of the image forming apparatus and for enhancing the speed thereof. To accommodate this demand, reduction in the size of the process units is currently undertaken. However, when the process units are reduced in size and enhanced in speed, the life of each process unit becomes short due to the deterioration, consumption, etc. of member that constitute the process units. This results in the life of each process unit not corresponding to the life of the image forming apparatus on the whole.

To address this problem, the process units are configured to be replaceable, so that when the process units reach the end of their lives, the process units are replaced with new process units. Each process unit configured to be replaceable is shipped from a factory in a state where a developer is contained in the housing of a developing device. This means that each process unit provided with the developing device using the two-component developer is also shipped in a state where the two-component developer is contained in the housing of the developing device.

In each of the developing devices, the developing sleeve inside the housing is partially caught in and exposed from the opening of the housing. Therefore, when each process unit is transported, the toner in the housing may leak from a gap between the outer circumferential surface of the developing sleeve and the edge of the opening, due to vibration during transportation or the like. When the leakage occurs, the toner inside the developing device is wasted. This impairs cost efficiency.

Also, in a case where an image forming apparatus is transported with the process units mounted therein, the toner contained in the housing of each developing device may leak from the gap between the outer circumferential surface of the developing sleeve and the edge of the opening, due to vibration during transportation or the like. In this case, the toner leaked from the developing devices will stain recording sheets, etc. inside the image forming apparatus.

Patent Literature 1 (Japanese application publication No. 07-20715) discloses a developing device in which a magnet roller is rotated with use of a grip. In this developing device, during transportation, the magnet roller is rotated by 180 degrees from a position where the magnet roller performs operations for image formation after being mounted on the image forming apparatus, so as to prevent toner from leaking from an opening of a housing.

According to Patent Literature 1, the magnet roller in the developing device is positioned such that magnetic poles, which face a photosensitive drum during image formation, face the inner side of the housing during transportation. Therefore, when the developing device is mounted in the image forming apparatus, a user of the image forming apparatus needs to change the positions of the magnetic poles in the magnet roller with use of the grip. However, if the user does not perform operations with use of the grip, the positions of the magnetic poles in the magnet roller do not change, failing in appropriately positioning the magnetic poles. This may cause the electrostatic latent image on the photosensitive drum not to be developed appropriately.

Also, when the magnet roller is rotated by 180 degrees, during transportation, from a position where the magnet roller performs operations for image formation, the toner in the housing is attracted by carriers. In the vicinity of the opening of the housing, however, the toner is not attracted by the carriers. As a result, the toner may leak out during transportation.

To solve this problem, it is possible to include, in the structure disclosed in Patent Literature 1, a device for automatically performing the operations using the grip when the developing device is mounted in the image forming apparatus. However, including such a device may impair cost efficiency, for the device per se has a complex structure, and a complex mechanism is required to provide the device in the structure of Patent Literature 1. Furthermore, it is necessary to secure a space in the image forming apparatus to provide the device, which may cause the image forming apparatus to increase in size.

SUMMARY OF THE INVENTION

The present invention provides a developing device for developing an electrostatic latent image formed on an outer circumferential surface of an image carrier, the developing device comprising: a housing that contains therein a two-component developer and has an opening facing the image carrier; a developing sleeve that is rotatably held in the housing and partially exposed from the opening of the housing to face the image carrier, with (i) a gap between an outer circumferential surface of the developing sleeve and an upstream edge of the opening and (ii) a gap between the outer circumferential surface thereof and a downstream edge of the opening, the upstream and the downstream edges of the opening respectively being an edge located upstream and an edge located downstream in a transfer direction of the two-component developer on the developing sleeve that rotates when developing the electrostatic latent image; a magnet roller that is arranged inside the developing sleeve and has a plurality of magnetic poles arranged along a circumferential direction of the magnet roller, the plurality of magnetic poles including first and second magnetic poles, the first magnetic pole having a strongest magnetic force among the plurality of magnetic poles, the second magnetic pole having a magnetic force equal to or larger than a predetermined value and being different from the first magnetic pole; and a positioning member operable to allow the magnet roller to rotate together with the rotation of the developing sleeve when the magnet roller is in a first rotational position, and to inhibit the rotation of the magnet roller when the magnet roller is in a second rotational position, the first rotational position being a position where one of the first and the second magnetic poles faces the downstream edge of the opening, the second rotational position being a position where the first magnetic pole is closest to the image carrier.

BRIEF DESCRIPTION OF THE DRAWINGS

These and the other objects, advantages and features of the invention will become apparent from the following description thereof taken in conjunction with the accompanying drawings which illustrate a specific embodiment of the present invention.

In the drawings.

DESCRIPTION OF PREFERRED EMBODIMENTS

<Structure of Image Forming Apparatus>

Figure 1:
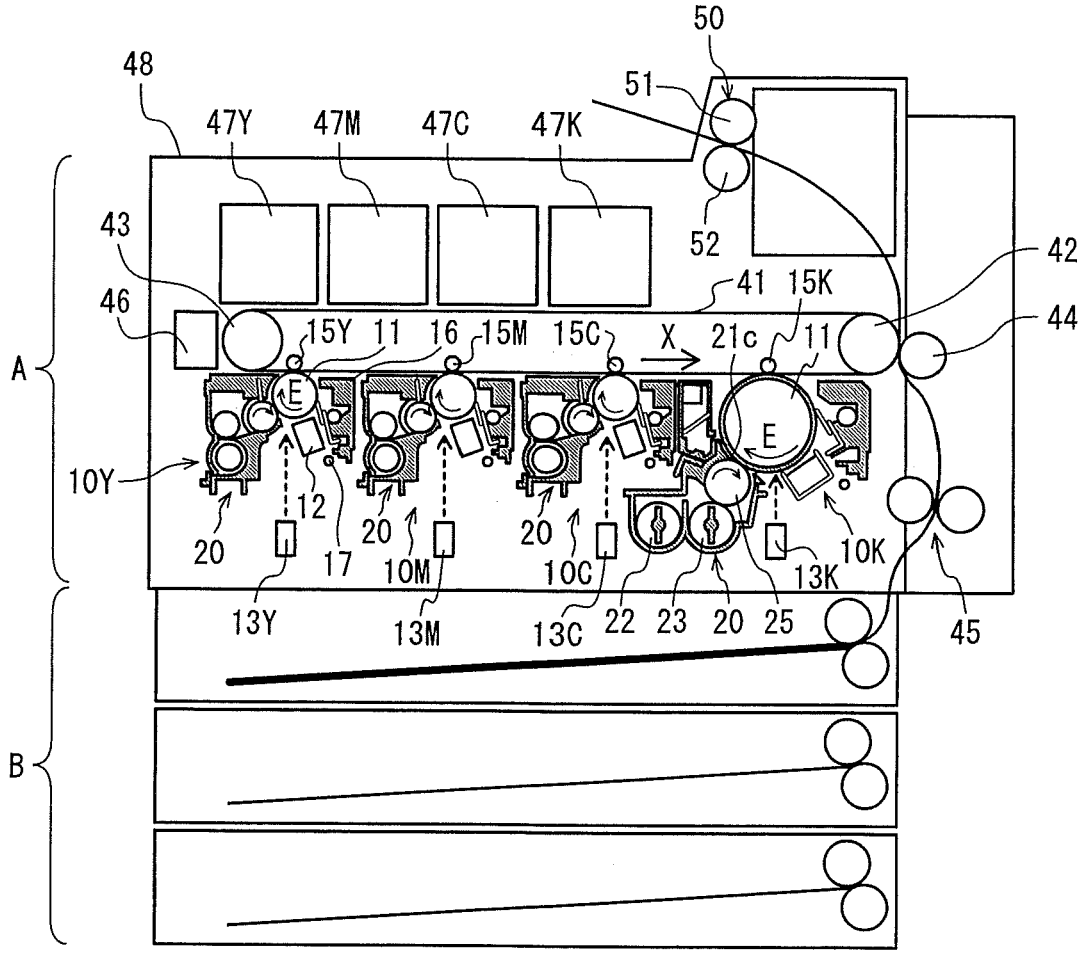
FIG. 1 schematically shows a structure of a tandem-type color digital printer, which is an image forming apparatus including a developing device according to an embodiment of the present invention.

FIG. 1 schematically shows a structure of a tandem-type color digital printer (hereinafter, simply "printer"), which is an image forming apparatus including a developing device according to an embodiment of the present invention. Upon receiving an instruction for executing a print job, the printer forms a full-color or monochrome image on a recording sheet (e.g., a recording paper, an OHP sheet, etc.) based on the instruction, in a known electrophotographic method.

The printer includes an image formation section A and a paper feeder B. The image formation section A forms toner images of the colors yellow (Y), magenta (M), cyan (C), and black (K) on a recording sheet. The paper feeder B is located below the image formation section A, and has a plurality of feed cassettes that contain recording sheets to be supplied to the image formation section A.

The image formation section A includes an intermediate transfer belt 41. The intermediate transfer belt 41 is wound around a pair of rollers 42 and 43 substantially at the center of the printer, in a manner that the intermediate transfer belt 41 includes a horizontal portion and is rotatable. The intermediate transfer belt 41 rotates in a direction indicated by an arrow X by a motor (not shown).

Below the intermediate transfer belt 41, process units 10Y, 10M, 10C, and 10K are arranged in the stated order from an upstream side in a rotation direction of the intermediate transfer belt 41. The process units 10Y, 10M, 10C, and 10K are provided to sequentially form toner images of the colors yellow (Y), magenta (M), cyan (C), and black (K) on the intermediate transfer belt 41.

The process units 10Y, 10M, 10C, and 10K are removably mounted in the image formation section A, by being inserted therein from a front end to a rear (back) end of the printer. The process units 10Y, 10M, 10C, and 10K are replaced by new process units 10Y, 10M, 10C, and 10K when reaching the end of their lives.

The process units 10Y, 10M, and 10C have the same structure. The process unit 10K, which forms a toner image with use of the toner of the color K, is shown larger than the other process units 10Y, 10M, and 10C. However, the process units 10Y, 10M, 10C, and 10K all have the same functions. Therefore, the following mainly describes the structure of the process unit 10Y.

The process unit 10Y has, as an image carrier, a photosensitive drum 11 that is arranged facing the intermediate transfer belt 41. An axis direction of the photosensitive drum 11 extends linearly from the front end to the rear end of the printer, along a width direction of the intermediate transfer belt 41. The photosensitive drum 11 rotates in a direction indicated by an arrow E.

An exposure device 13Y is arranged below the photosensitive drum 11. The exposure device 13Y forms an electrostatic latent image by irradiating a surface of the photosensitive drum 11 with use of a laser beam. The exposure device 13Y is mounted in the image formation section A. Note that exposure devices 13M, 13C, and 13K for irradiating the photosensitive drums of the process units 10M, 10C, and 10K are also included in the image formation section A.

The process unit 10Y includes a charging device 12 for uniformly charging the surface of the photosensitive drum 11. The charging device 12 is arranged adjacent to the photosensitive drum 11, in a position farther upstream in a rotation direction of the photosensitive drum 11 than a part of the surface of the photosensitive drum 11 on which the laser beam is irradiated by the exposure device 13Y. Also, a developing device 20 is arranged adjacent to the photosensitive drum 11, in a position farther downstream in the rotation direction of the photosensitive drum 11 than the part of the surface of the photosensitive drum 11 which is irradiated with use of the laser beam. As the photosensitive drum 11 rotates, the surface thereof is charged by the charging device 12, and thereafter irradiated with the laser beam by the exposure device 13Y. In this way, an electrostatic latent image is formed on the surface of the photosensitive drum 11. The electrostatic latent image formed on the surface of the photosensitive drum 11 is developed with toner by the developing device 20.

Here, the developing device 20 of the process unit 10K has a different structure from the developing devices 20 of the process units 10Y, 10M, and 10C. However, the developing device 20 of the process unit 10K has the same functions as the developing devices 20 of the process units 10Y, 10M, and 10C.

After the electrostatic latent image is developed with use of the toner by the developing device 20, a toner image is formed on the photosensitive drum 11. The toner image is transferred onto the intermediate transfer belt 41 by a primary transfer roller 15Y, which is arranged opposite from the photosensitive drum 11 via the intermediate transfer belt 41. The primary transfer roller 15Y is mounted in the image formation section A.

Note that primary transfer rollers 15M, 15C, and 15K for transferring toner images on the photosensitive drums 11 of the process units 10M, 10C, and 10K are also mounted in the image formation section A. The toner images formed on the photosensitive drums 11 of the process units 10Y, 10M, 10C, and 10K are transferred onto the same area of the intermediate transfer belt 41 by the primary transfer rollers 15Y, 15M, 15C, and 15K.

The process unit 10Y includes a cleaning device 16 and a charge removal device 17. The cleaning device 16 is provided to clean the surface of the photosensitive drum 11 from which the toner image is transferred onto the intermediate transfer belt 41. The charge removal device 17 removes charge from the surface of the photosensitive drum 11 after the cleaning device 16 cleans the surface thereof. Note that each of the process units 10M, 10C, and 10K also has the cleaning device 16 and the charge removal device 17 for the corresponding photosensitive drum 11.

The image formation section A includes a secondary transfer roller 44, which is arranged opposite from the roller 42 via the intermediate transfer belt 41. The roller 42 is arranged close to the process unit 10K that is located most downstream in the rotation direction of the intermediate transfer belt 41. The secondary transfer roller 44 is pressed against the intermediate transfer belt 41, and a transfer nip is formed in the pressed portion.

A recording sheet contained in a feed cassette of the paper feeder B is transferred to the transfer nip. The recording sheet is transferred to the transfer nip by a pair of timing rollers 45, in synchronization with a timing at which the toner images formed on the intermediate transfer belt 41 are transferred to the transfer nip. The toner images formed on the intermediate transfer belt 41 are pressed against the recording sheet that passes through the transfer nip. Then, the toner images are collectively transferred onto the recording sheet by an electrostatic force in an electric field, which is formed by the secondary transfer roller 44.

Note that the toners for forming the toner images on the intermediate transfer belt 41 may not be transferred onto the recording sheet completely, depending on the magnitude of the electrostatic force of the secondary transfer roller 44. In this case, some of the toners (hereinafter "residual toner") may remain on the intermediate transfer belt 41. However, the residual toner is electrically and mechanically removed by a residual-toner removal device 46. The residual-toner removal device 46 is arranged opposite from the roller 43, which is arranged close to the process unit 10Y via the intermediate transfer belt 41.

After passing through the transfer nip, the recording sheet is transferred to a fixing unit 50 provided in an upper part of the image formation section A. The fixing unit 50 includes a heating roller 51 and a pressure roller 52 that are pressed against each other, thereby forming a fixing nip. The heating roller 51 includes a heater lamp (not shown) in the center part thereof, so as to heat the heating roller 51.

After passing through the transfer nip, the recording sheet is transferred to the fixing unit 50. While the recording sheet passes through the fixing nip, the toner images are fixed onto the recording sheet with heat and pressure. After the toner images are fixed on the recording sheet by the fixing unit 50, the recording sheet is ejected onto an ejection tray 48 located in an upper part of the printer, in a state where a side of the sheet on which the toner images are formed faces down.

The developing devices 20 in the process units 10Y, 10M, 10C, and 10K develop the electrostatic latent images on the respective photosensitive drums, with use of the two-component developer (i.e., magnetic carriers and toners). The toners of the colors Y, M, C, and K are supplied from toner hoppers 47Y, 47M, 47C, and 47K, which are located above the intermediate transfer belt 41. The developing devices 20 provided for the process units other than the process unit 10K, namely the process units 10Y, 10M, and 10C, have the same structure.

<Structure of Developing Device>

Figure 2:
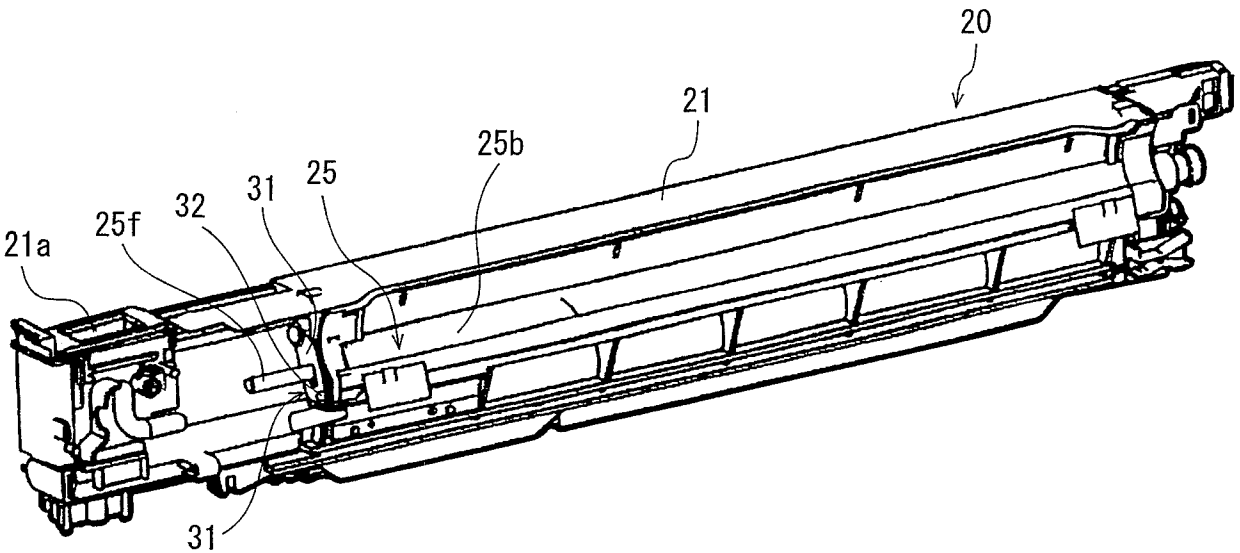
FIG. 2 is a perspective view of the developing device included in a process unit of the printer shown in FIG. 1.
Figure 3:
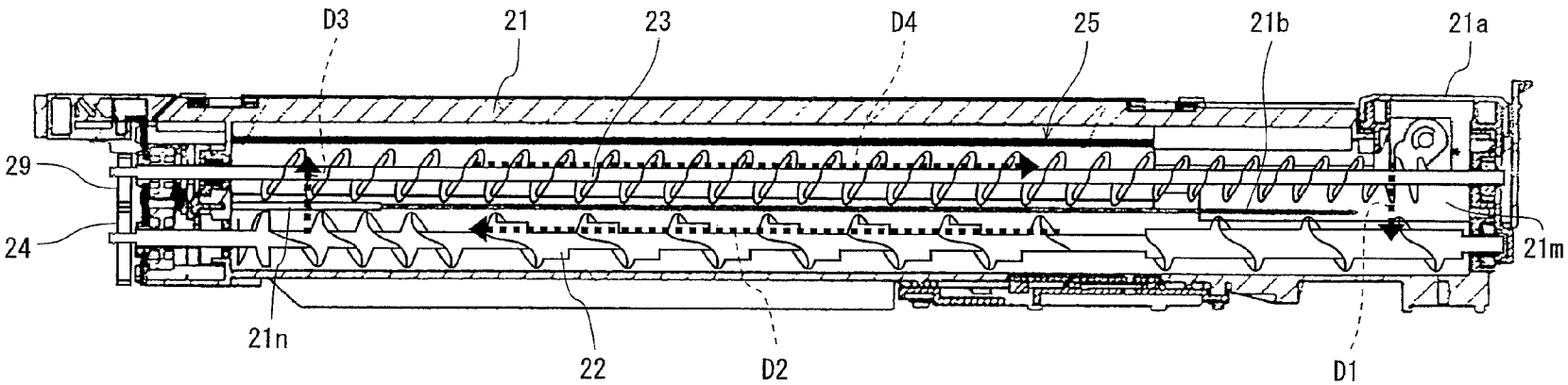
FIG. 3 is a longitudinal sectional view of the developing device.
Figure 4:
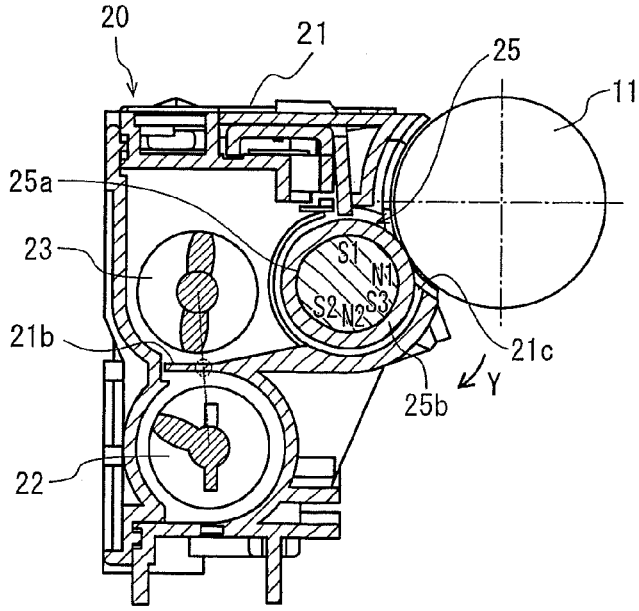
FIG. 4 is a transverse sectional view of the developing device.

FIG. 2 is a perspective view of the developing device 20 mounted in each of the process units 10Y, 10M, and 10C. FIG. 3 is a longitudinal sectional view of the developing device 20. FIG. 4 is a transverse sectional view of the developing device 20. Note that the left and right directions in the longitudinal sectional view in FIG. 3 are inverted compared to the left and right directions in the perspective view of FIG. 2.

The developing device 20 has a housing 21 that linearly extends along the axis direction of the photosensitive drum 11. A toner supply opening 21*a* is provided in an upper surface of an end portion of the housing 21.

The process units 10Y, 10M, and 10C are mounted in the image formation section A, by being inserted therein in a manner that another end portion of the developing device 20, which is located opposite from the end portion having the toner supply opening 21*a*, is inserted first into the image formation section A.

When the process units 10Y, 10M, and 10C are mounted in the image formation section A, the housings 21 are positioned extending from the front end to the rear end of the printer. This being so, the toners in the toner hoppers in the image formation section A are each supplied to the corresponding housing 21 via the toner supply opening 21*a*.

As shown in FIGS. 3 and 4, a first toner transfer screw 22 is provided at a lower portion in the housing 21, and a second toner transfer screw 23 is provided at an upper portion in the housing 21. The first toner transfer screw 22 extends along the longitudinal direction of the housing 21. The second toner transfer screw 23 extends in parallel with the first toner transfer screw 22. A partition 21*b* is arranged between the first toner transfer screw 22 and the second toner transfer screw 23. The first toner transfer screw 22 and the second toner transfer screw 23 extend from the end portion of the housing 21 in which the toner supply opening 21 a is provided to the opposite end portion of the housing 21.

The shafts of the first toner transfer screw 22 and the second toner transfer screw 23 protrude outwardly from the housing 21 at the end portion located opposite from the end portion in which the toner supply opening 21 a is provided. A gear 24 is provided for the tip of the protrusion of the first toner transfer screw 22, and a gear 29 is provided for the tip of the protrusion of the second toner transfer screw 23. The gears 24 and 29 are engaged with each other, so that a drive force is transferred between the first toner transfer screw 22 and the second toner transfer screw 23. When the developing device 20 is driven, the first toner transfer screw 22 and the second toner transfer screw 23 rotate in directions opposite to each other.

Note that when the process unit is mounted in the image formation section A, a motor for driving the image formation section A is connected to a drive mechanism of the process unit by means of a coupling structure (not shown). In this way, the power of the motor for driving the image formation section A is transferred to the first toner transfer screw 22 and the second toner transfer screw 23.

As shown in FIG. 4, a developing roller 25 is arranged facing the surface of the photosensitive drum 11, and adjacent to the second toner transfer screw 23, in the upper portion of the housing 21. The developing roller 25 has a substantially same length as the length of the photosensitive drum 11 in the axis direction thereof, and is arranged in parallel with the second toner transfer screw 23. Note that as shown in FIG. 3, the developing roller 25 is shorter than each of the first toner transfer screw 22 and the second toner transfer screw 23. Also, one end of the developing roller 25 that is closer to the toner supply opening 21 a is located closer to the center of the developing device 20 in the longitudinal direction than ends of the first toner transfer screw 22 and the second toner transfer screw 23 that are closer to the toner supply opening 21*a*.

As shown in FIG. 3, the toner supplied to the inside of the housing 21 via the toner supply opening 21*a* goes through a first developer through-hole 21*m* arranged at one end portion of the partition 21*b*. Then, as shown by an arrow D1 in FIG. 3, the toner falls to the bottom of the housing 21. Then, as shown by an arrow D2 in FIG. 3, the toner is transferred to the end portion of the housing 21 at which the toner supply opening 21*a* is not provided, by means of the rotation of the first toner transfer screw 22. While being transferred by the first toner transfer screw 22, the toner is agitated with the magnetic carriers contained inside the housing 21.

After being transferred to the end portion of the housing 21 at which the toner supply opening 21*a* is not provided, the toner goes through a second developer through-hole 21*n* arranged in the partition 21*b*, together with the magnetic carriers. Then, as shown by an arrow D3 in FIG. 3, the toner is transferred to an upper portion inside the housing 21 where the second toner transfer screw 23 is arranged.

The second toner transfer screw 23 rotates in a direction opposite from the first toner transfer screw 22. In this way, the second toner transfer screw 23 transfers the toner and the carriers to a direction opposite from the direction in which the first toner transfer screw 22 transfers the toner and the carriers, along an axis direction of the developing roller 25, as shown by an arrow D4 in FIG. 3. In the course of the transfer of the toner and the carriers by the second toner transfer screw 23, the toner and the carriers are transferred to the photosensitive drum 11 by the developing roller 25.

Figure 5:
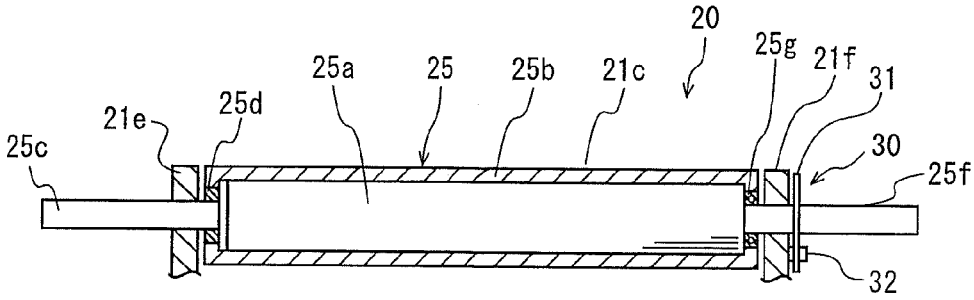
FIG. 5 is a horizontal sectional view for explaining a structure of a developing roller in the developing device.

FIG. 5 is a horizontal sectional view for explaining a structure of the developing roller 25. As shown in FIGS. 4 and 5, the developing roller 25 has a magnet roller 25*a* and a developing sleeve 25*b*. The magnet roller 25*a* has a columnar shape and is arranged in parallel with the photosensitive drum 11. The developing sleeve 25*b* has a cylindrical shape, and encases the magnet roller 25*a*. The developing sleeve 25*b* is made of aluminum.

A sleeve drive shaft 25*c* is connected to the developing sleeve 25*b* to be integrated therewith by a connector 25*d*, at an end surface of the developing sleeve 25*b* which is located opposite from the end portion where the toner supply opening 21*a* is provided. The sleeve drive shaft 25*c* extends outwardly from the developing sleeve 25*b* along the axis of the developing sleeve 25*b*. The sleeve drive shaft 25*c* penetrates through an end surface 21*e* of the housing 21, and is rotatably supported by the end surface 21*e*.

When the process unit is mounted in the image formation section A, a rotational drive force by the motor for driving the image formation section A is transferred to the sleeve drive shaft 25*c* by means of the coupling structure (not shown). At the time of developing an electrostatic latent image on the photosensitive drum 11, the sleeve drive shaft 25*c* is rotated to cause the developing sleeve 25*b* to rotate in a direction shown by an arrow Y in FIG. 4, together with the sleeve drive shaft 25*c*.

Figure 6:
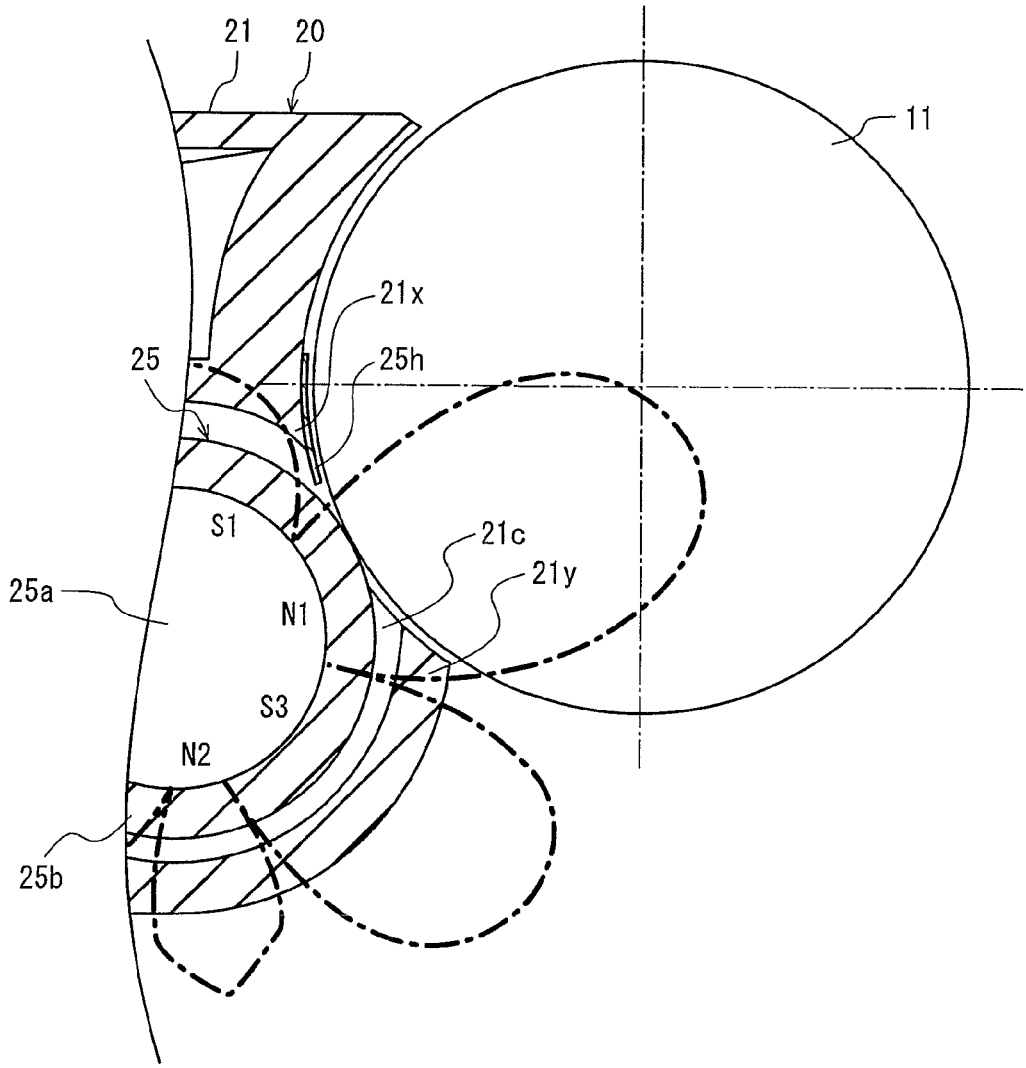
FIG. 6 is a magnified sectional view showing a portion of the developing roller that faces the photosensitive drum.

FIG. 6 is a magnified sectional view showing a portion of the developing roller 25 that faces the photosensitive drum 11. As shown in FIG. 6, the housing 21 has an opening 21*c* along the axis direction of the photosensitive drum 11, in a manner that a surface of the developing sleeve 25*b* faces a surface of the photosensitive drum 11. The surface of the developing sleeve 25*b* and the surface of the photosensitive drum 11 are mutually adjacent to each other via the opening 21*c*.

An upper edge 21*x* of the opening 21*c* is located upstream in the rotation direction of the developing sleeve 25*b*, namely in a transfer direction of the two-component developer on the outer circumferential surface of the developing sleeve 25*b*. The upper edge 21*x* is provided with a blade 25*h* that protrudes toward the developing sleeve 25*b*. The blade 25*h* is a regulator for regulating the amount of the two-component developer that is transferred on the outer circumferential surface of the developing sleeve 25*b* when the developing sleeve 25*b* rotates. The blade 25*h* is arranged in a manner that a gap of approximately 0.3 mm is formed between a tip of the blade 25*h* and the surface of the developing sleeve 25*b*.

A lower edge 21*y* of the opening 21*c* is located downstream in the rotation direction of the developing sleeve 25*b*, with a gap of approximately 1.0 to 1.5 mm between the lower edge

21*y* and the surface of the developing sleeve 25*b*. A bottom surface of the housing 21, which is continuous from the lower edge 21*y*, is in the shape of an arc along the outer circumferential surface of the developing sleeve 25*b*. There is a gap of approximately 1.0 to 1.5 mm between a bottom inner surface of the housing 21 and the outer circumferential surface of the developing sleeve 25*b*.

As shown in FIG. 4, five magnetic poles are arranged along a circumferential direction of the magnet roller 25*a* in the developing sleeve 25*b*. Each of the five magnetic poles is arranged in a different one of five areas in the magnet roller 25*a*. The five areas are obtained by dividing the magnet roller 25*a* into six areas in the circumferential direction thereof and excluding one of the six areas. Specifically, a first S-pole S1 and a second S-pole S2 are respectively arranged in a first area and a second area from among the six areas of the magnet roller 25*a*. The first and second areas are arranged on both sides of an area that does not include any magnetic poles, where the first area is located farther downstream in the rotation direction of the developing sleeve 25*b* than the area that does not include any magnetic poles. A first N-pole N1 and a second N-pole N2 are respectively arranged in a third area and a fourth area from among the six areas of the magnet roller 25*a*. The third area in which the first N-pole N1 is arranged is adjacent to the first area in which the first S-pole S1 is arranged, and is located opposite from the area that does not include any magnetic poles, with the first area in between. The fourth area in which the second N-pole N2 is arranged is adjacent to the second area in which the second S-pole S2 is arranged, and is located opposite from the area that does not include any magnetic poles, with the second area in between. A third S-pole S3 is arranged in a fifth area located between the third area in which the first N-pole N1 is arranged and the forth area in which the second N-pole N2 is arranged.

Figure 7A:
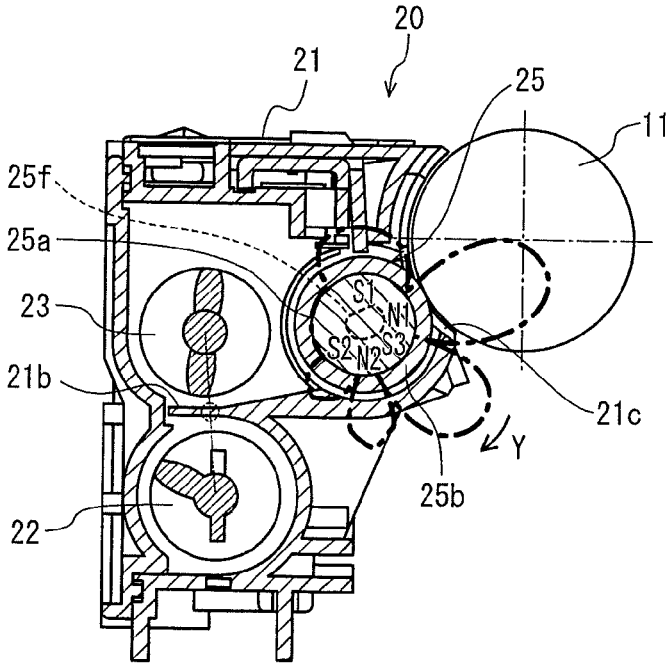
FIG. 7A is a transverse sectional view of the developing device for explaining a pattern of magnetic force lines of magnetic poles provided for a magnet roller.

FIG. 7A is a transverse sectional view of the developing device 20 for explaining a pattern of magnetic force lines of the magnetic poles provided for the magnet roller 25*a*. As shown in FIG. 7A, the magnetic force of the first N-pole N1 is the strongest of all the magnetic poles in the magnet roller 25*a*. Then, the magnetic force becomes weaker in the order of the third S-pole S3, the first S-pole S1, the second N-pole N2, and the second S-pole S2. The first N-pole N1 having the strongest magnetic force is arranged in a manner that, when the process unit is mounted in the image formation section A, the first N-pole N1 is fixed in a position closest to the photosensitive drum 11 via the opening 21*c* provided in the housing 21.

As shown in FIG. 5, a roller rotation shaft 25*f* is connected to the magnet roller 25*a* to be integrated therewith, at an end surface of the magnet roller 25*a* which is located opposite from the end surface where the sleeve drive shaft 25*c* is provided. The roller rotation shaft 25*f* penetrates through an end surface of the developing sleeve 25*b*, which is located opposite from the end surface to which the sleeve drive shaft 25*c* is attached. The roller rotation shaft 25*f* extends from the developing sleeve 25*b* along the axis of the magnet roller 25*a* having a columnar shape, and is rotatably supported by a bearing 25*g*.

The roller rotation shaft 25*f* penetrates through an end surface 21*f*, which is located opposite from the end surface 21*e* that holds the sleeve drive shaft 25*c* of the housing 21, and extends outwardly from the housing 21. The roller rotation shaft 25*f* is rotatably supported by the end surface 21*f* of the housing 21.

A portion of the roller rotation shaft 25*f* that protrudes outwardly from the housing 21 has a D-shaped cross section (shown by dashed lines in FIG. 7A). A positioning plate 31 is attached to the portion having the D-shaped cross section. Also, a positioning pin 32 for positioning the positioning plate 31 is attached to the end surface 21*f* of the housing 21.

The positioning plate 31 and the positioning pin 32 constitute a positioning member 30 for holding the magnet roller 25*a* at a predetermined position with respect to the housing 21. As described below, the positioning member 30 holds the magnet roller 25*a* at a second rotational position with respect to the housing 21, after the process unit is mounted in the image formation section A. Also, the positioning member 30 holds the magnet roller 25*a* at a first rotational position with respect to the housing 21, before the process unit is mounted in the image formation section A.

Figure 7B:
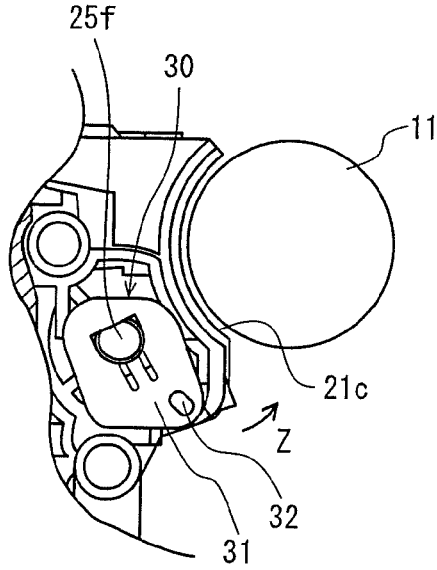
FIG. 7B is a side view of a portion of the developing device where a positioning member is attached.

FIG. 7B is a side view showing a portion of the developing device 20 where the positioning member 30 is attached. Note that FIG. 7B shows a state where the magnet roller 25*a* is positioned by the positioning member 30, after the process unit is mounted in the image formation section A. In this case, as shown in FIG. 7A, the magnet roller 25*a* is held at the second rotational position where the first N-pole N1 in the magnet roller 25*a*, which has the strongest magnetic force, is positioned closest to the surface of the photosensitive drum 11 via the developing sleeve 25*b* and the opening 21*c* of the housing 21.

Figure 8:
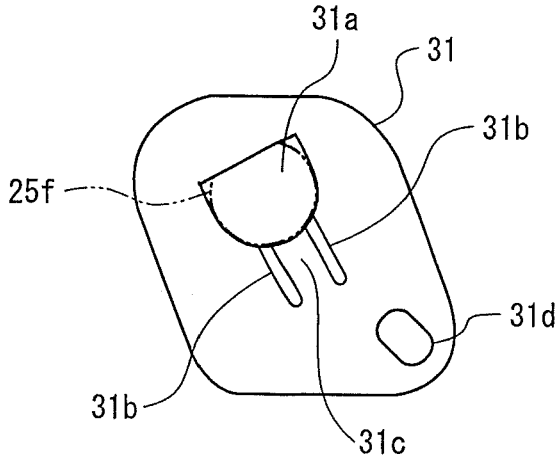
FIG. 8 is a plan view of a positioning plate that constitutes the positioning member.

FIG. 8 is a plan view of the positioning plate 31. The positioning plate 31 is made of a flat plate having flexibility (spring characteristics), such as an SUS plate, and has a parallelogram shape. The positioning plate 31 has a through-hole 31*a* which the roller rotation shaft 25*f* passes through. The through-hole 31*a* is formed more upward than the middle part of the positioning plate 31. The through-hole 31*a* has a D-shaped cross section, which corresponds to the cross section of the roller rotation shaft 25*f*. The D-shaped cross section of the through-hole 31 is formed by an upper side edge that is linear and a lower side edge that is curved downward in the shape of an arc. The positioning plate 31 is unrotatably attached to the roller rotation shaft 25*f* having the D-shaped cross section, by the roller rotation shaft 25*f* being inserted into the through-hole 31*a*.

The positioning plate 31 includes a pair of grooves 31*b* that are in parallel with each other, and a strip 31*c* that is formed between the grooves 31*b*. The grooves 31*b* extend obliquely downward from the lower side edge of the through-hole 31*a* that is curved downward in the shape of an arc. The strip 31*c* has a rectangular shape, and functions as a plate spring. When the roller rotation shaft 25*f* is inserted into the through-hole 31*a*, a tip of the strip 31*c* makes contact with an arc-shaped surface of the roller rotation shaft 25*f*, and is bent in an insertion direction of the roller rotation shaft 25*f*. In this way, the strip 31*c* presses the surface of the roller rotation shaft 25*f*, enabling the positioning plate 31 to be attached to the roller rotation shaft 25*f* to be integrated therewith without moving in the axis direction of the roller rotation shaft 25*f*. As a result, when the roller rotation shaft 25*f* rotates, the positioning plate 31 rotates together with the roller rotation shaft 25*f*.

The positioning plate 31 has a positioning hole 31*d* in the vicinity of one of the corners located at the bottom of the positioning plate 31. The positioning pin 32 attached to the end surface 21*f* of the housing 21 is inserted into the positioning hole 31*d*, when the positioning plate 31 rotates together with the roller rotation shaft 25*f* in a direction shown by an arrow Y in FIG. 7A. The positioning plate 31 is fixed to a predetermined position with respect to the end surface 21*f* of the housing 21, by the positioning pin 32 being inserted into the positioning hole 31*d*.

When the positioning pin 32 is inserted into the positioning hole 31*d*, (i) the roller rotation shaft 25*f* to which the positioning plate 31 is attached so as to be integrated therewith and (ii) the magnet roller 25*a* to which the roller rotation shaft 25*f* is attached so as to be integrated therewith are also fixed to predetermined positions with respect to the housing 21. As shown in FIG. 7A, the first N-pole N1 of the magnet roller 25*a* is positioned (fixed) in a position (second rotational position) closest to the surface of the photosensitive drum 11 via the developing sleeve 25*b* and the opening 21*c* of the housing 21.

As described above, the magnet roller 25*a* is fixed to the second rotational position after the process unit is mounted in the image formation section A. Assume here that the process unit is shipped from a factory without being mounted in the image formation section A, or that the process unit is shipped from the factory after being mounted in the image formation section A. In this case, after the positioning pin 32 is unlatched from the positioning hole 31*d*, the positioning plate 31 is rotated by a predetermined angle (approximately 15 degrees) in a direction shown by an arrow Z in FIG. 7B (i.e., direction opposite from the rotation direction of the developing sleeve 25*b* when developing electrostatic latent images), so as to be in a first rotational position.

Figure 9:
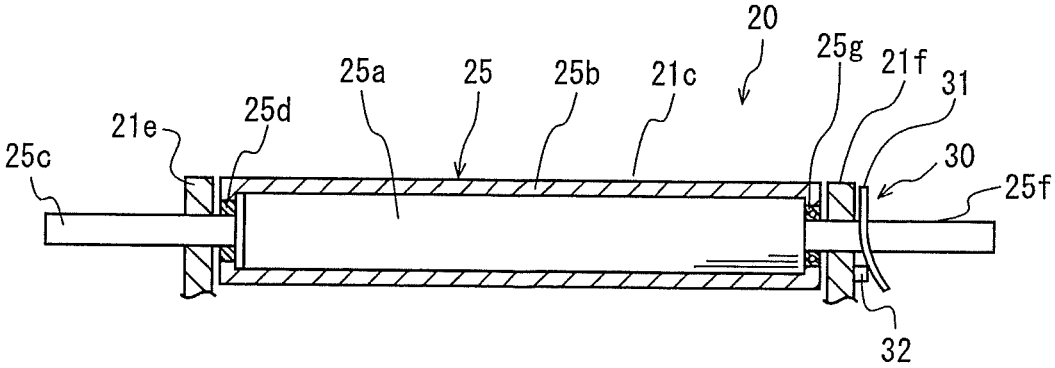
FIG. 9 is a horizontal sectional view of the developing roller for explaining a position of the positioning member when the process unit is shipped from a factory.
Figure 10A:
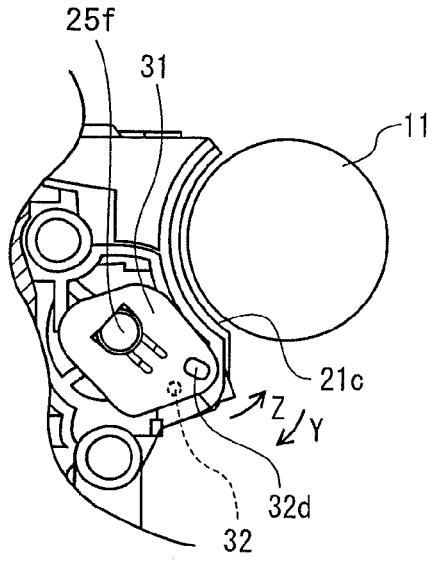
FIG. 10A is a side view of a portion of the developing device where the positioning member is attached, when the process unit is shipped from the factory.
Figure 10B:
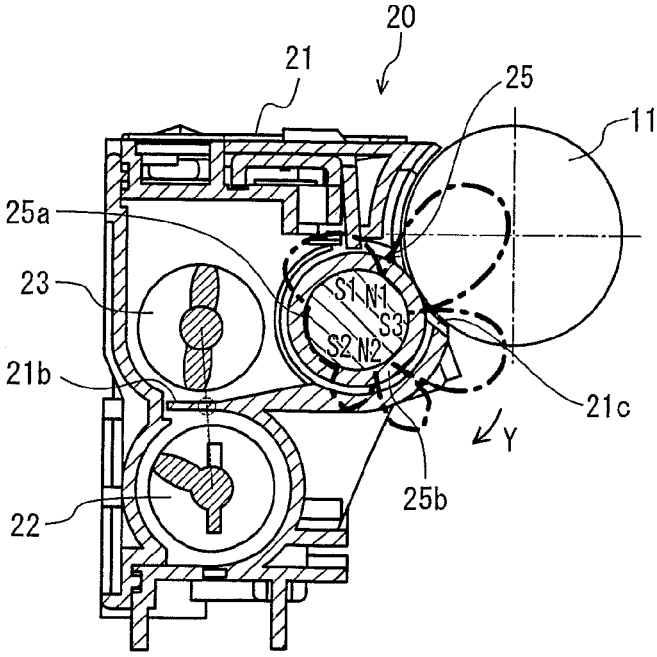
FIG. 10B is a transverse sectional view of the developing device for explaining a pattern of the magnetic force lines of the magnetic poles, when the process unit is shipped from the factory.
Figure 11:
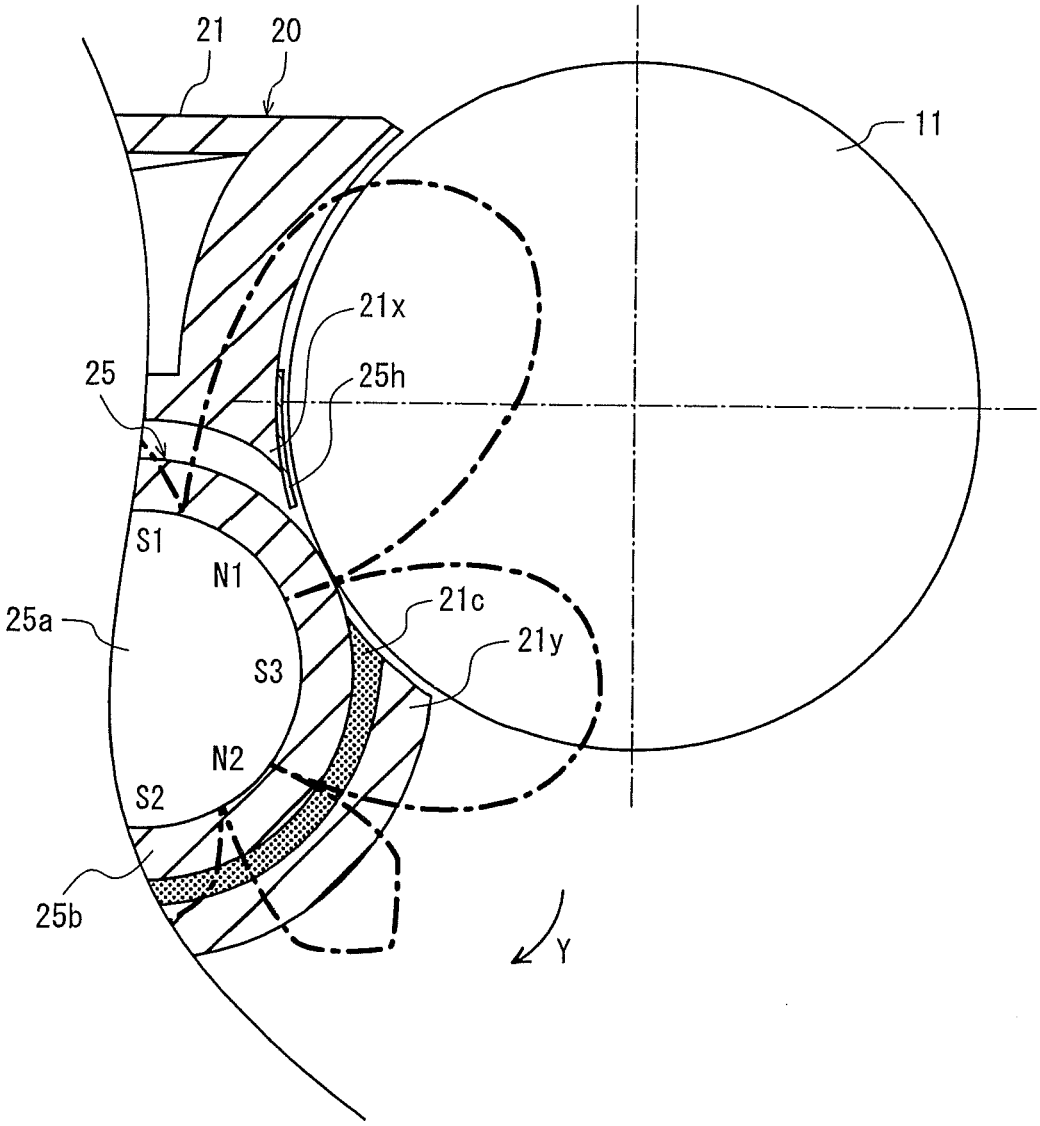
FIG. 11 is a magnified view of a main part of the pattern of the magnetic lines shown in FIG. 10B.

FIG. 9 is a horizontal sectional view of the developing roller 25 for explaining a position of the positioning member 30 when the process unit is shipped from the factory. FIG. 10A is a side view of a portion of the developing device 20 where the positioning member 30 is attached, when the process unit is shipped from the factory. FIG. 10B is a transverse sectional view of the developing device 20 for explaining a pattern of the magnetic force lines of the magnetic poles in the magnet roller 25*a*, when the process unit is shipped from the factory. FIG. 11 is a magnified view of a main part of the pattern of the magnetic lines shown in FIG. 10B.

After the positioning pin 32 is unlatched from the positioning hole 31*d*, the positioning plate 31 is rotated around the roller rotation shaft 25*f*, in a direction shown by an arrow Z in FIG. 10A. In this case, a lower side edge of the positioning plate 31 bends to press against the tip of the positioning pin 32, as shown in FIG. 9.

In such a state as described above, the positioning plate 31 is rotated until the magnet roller 25*a* is positioned in a first rotational position in which a portion of the magnet roller 25*a* where the magnetic force of the third S-pole S3 becomes maximum faces the lower edge 21*y* of the opening 21*c* in the housing 21, as shown in FIG. 10B and FIG. 11. When the magnet roller 25*a* is positioned in the first rotational position, the rotation of the positioning plate 31 is stopped.

In this case, the positioning plate 31 that has been bent presses against the tip of the positioning pin 32 by the spring characteristics of the positioning plate 31 itself. This enables the positioning plate 31 to be held in the state of not being rotated by the friction with the positioning pin 32. As a result, the magnet roller 25*a* to which the positioning plate 31 is attached so as to be integrated therewith is also held in the state of not being rotated.

Here, a "holding force P1" refers to a force that holds the positioning plate 31 (consequently the magnet roller 25*a*) in the state of not being rotated by the friction with the positioning pint 32.

When the magnet roller 25*a* is held in the state of not being rotated, magnetic carriers contained in the housing 21 are attracted to the surface of the developing sleeve 25*b* by the magnetic force of each magnetic pole in the magnet roller 25*a* inside the housing 21.

In this case, the portion of the magnet roller 25*a* where the magnetic force of the third S-pole S3 becomes maximum roughly faces the lower edge 21*y* of the opening 21*c*, as shown in FIG. 11. As a result, the third S-pole S3 causes magnetic carriers in a portion of the housing 21, which is located opposite from the opening 21*c* of the housing 21, to be retained in a gap between the outer circumferential surface of the developing sleeve 25*b* and the lower inner surface of the housing 21.

In such a state as described above, the toner in the housing 21 is inhibited from flowing through the gap between the lower edge 21*y* of the opening 21*c* and the outer circumferential surface of the developing sleeve 25*b*, by the magnetic carriers retained in the gap. As a result, the toner is prevented from leaking out from the gap.

Note that in this case, the magnet roller 25*a* is held in the state of not being rotated by the positioning plate 31 being pressed against positioning pin 32, and also by the magnetic carriers in the housing 21 that are attracted by the magnetic force of each magnetic pole in the magnet roller 25*a* via the developing sleeve 25*b*.

As described above, when shipped from the factory without being mounted in the image formation section A of the image forming apparatus or when shipped from the factory after being mounted in the image formation section A, the process unit is in the state where the magnet roller 25*a* in the developing device 20 is held by the positioning plate 31 such that the third S-pole S3 is positioned in the first rotational position. Therefore, in a case where the process unit is (i) shipped solely, (ii) shipped after being mounted in the image formation section A of the printer (i.e., image forming apparatus), or (iii) to be mounted in the image formation section A, the process unit is held in the state where (a) the magnet roller 25*a* is not rotated by vibration or the like and (b) the magnetic carriers are retained in the gap between the lower edge 21*y* of the opening 21*c* of the housing 21 and the developing sleeve 25*b*. This prevents the toner in the housing 21 from leaking through the gap.

Assume here that the process unit in the image formation section A of the printer is replaced by a new process unit. In this case, the sleeve drive shaft 25*c*, which is connected to the developing sleeve 25*b* to be integrated therewith, becomes rotatable by the motor of the image formation section A after the new process unit is mounted in the image formation section A. While the process unit is mounted in the image formation section A, the sleeve drive shaft 25*c* is rotatable by the motor of the image formation section A.

In such a state as described above, when, for example, the image formation section A is driven for image formation, the developing sleeve 25*b* is rotated in a direction shown by an arrow Y in FIG. 11.

When the developing sleeve 25*b* is rotated, the magnetic carriers in the housing 21 are transferred together with the toner on the outer circumferential surface of the developing sleeve 25*b*. At this time, the magnet roller 25*a* is held in the state of not being rotated by the positioning plate 31 pressing against the positioning pin 32. However, when the developing sleeve 25*b* is rotated, the magnetic force of each magnetic pole in the magnet roller 25*a* acts on the magnetic carriers transferred on the outer circumferential surface of the developing sleeve 25*b*. As a result, a rotational force (hereinafter, the magnitude of the rotational force is referred to as "Q") of the magnetic carriers, which is a force that tries to rotate together with the developing sleeve 25*b* in the same direction as the developing sleeve 25*b*, is applied to the magnet roller 25*a*.

As the developing sleeve 25*b* is rotated continuously, the amount of the carriers and the toner held and transferred by the developing sleeve 25*b* increases. Accordingly, the rotational force Q of the magnet carriers that acts on the magnet roller 25*a* increases as well. When the rotational force exceeds the holding force P1 which holds the positioning plate 31 (consequently the magnet roller 25*a*) in the state of not being rotated (P1<Q), the positioning plate 31 is rotated together with the developing sleeve 25*b* in the same direction as the developing sleeve 25*b*.

As a result, the positioning plate 31 that is in the first rotational position is rotated in the direction shown by an arrow Y in FIG. 10A. After the positioning plate 31 is rotated by a predetermined degree (approximately 15 degrees) in the direction shown by the arrow Y, the positioning pin 32 is inserted into the positioning hole 31*d* in the positioning plate 31. This enables the positioning pin 32 to be latched by the positioning hole 31*d*, holding the positioning plate 31 in the second rotational position with respect to the housing 21.

In this case, as shown in FIG. 6, the magnet roller 25*a* is positioned (fixed) such that a portion of the magnet roller 25*a* where the magnetic force of the first N-pole N1 becomes maximum is closest to the surface of the photosensitive drum 11 via the developing sleeve 25*b* and the opening 21*c* of the housing 21.

In this case, although not pressed against the positioning pin 32, the positioning plate 31 latches the positioning pin 32. This enables the magnet roller 25*a* to be fixed in the state of not being rotated with respect to the housing 21. Here, a "fixing force P2" refers to a force that fixes the magnet roller 25*a* in the state of not being rotated by the positioning plate 31 latching the positioning pin 32. The fixing force P2 is greater than the aforementioned holding force P1 (P2>P1). Also, the fixing force P2 is greater than the rotational force Q that acts on the magnet roller 25*a* by the rotation of the developing sleeve 25*b* (P2>Q).

In this case, while the magnet roller 25*a* is fixed to the housing 21, the developing sleeve 25*b* alone is rotated in a direction shown by the arrow Y in FIG. 7A. This enables the carriers and the toner to be transferred on the outer circumferential surface of the developing sleeve 25*b*, by the magnetic poles in the magnet roller 25*a*. The carriers and the toner transferred on the outer circumferential surface of the developing sleeve 25*b* is regulated to a predetermined amount by the blade 25*h* arranged in the upper edge 21*x* of the housing 21. Subsequently, the first N-pole N1 of the magnet roller 25*a* causes the carriers and the toner to form a magnetic brush. With this magnetic brush, the toners are adhered to the electrostatic latent image of the photosensitive drum 11. In this way, the electrostatic latent image is developed with use of the toner.

In this case, since the first N-pole N1 has the strongest magnetic force in the magnet roller 25*a*, the carriers are prevented from scattering from the developing sleeve 25*b*.

When images are developed afterward, the aforementioned operations for developing electrostatic latent images are performed with the magnet roller 25*a* fixed to the housing 21.

Note that as shown in FIG. 1, the developing device 20 provided for the process unit 10K, which forms a toner image with use of the toner of the color K includes the first and second toner transfer screws 22 and 23 and the developing roller 25. The first and second toner transfer screws 22 and 23 are arranged adjacent to each other in a horizontal direction at the bottom of the housing 21, and the developing roller 25 is arranged above the second toner transfer screw 23. Also, the developing roller 25 faces the photosensitive drum 11 through the opening 21*c* provided in an upper portion of the housing 21. The other structure of the developing device 20 of the process unit 10K is the same as that of the developing devices 20 of the process units 10Y, 10M, and 10C.

The developing device 20 of the process unit 10K with the aforementioned structure is also provided with the positioning member 30 for fixing the magnet roller 25*a*, in the same manner as the process units 10Y, 10M, and 10C. With this positioning member 30, the magnet roller 25*a* is held in the first rotational position in which a portion of the magnet roller 25*a* where the magnetic force of the third S-pole S3 becomes maximum faces the lower edge 21*y* of the opening 21*c* in the housing 21, before the process unit 10K is mounted in the image formation section A of the printer. Also, after the process unit 10K is mounted in the image formation section A, the magnet roller 25*a* is held, by the rotation of the developing sleeve 25*b*, in the second position in which a portion of the magnet roller 25*a* where the magnetic force of the first N-pole N1 becomes maximum is closest to the surface of the photosensitive drum 11.

Note that in the embodiment as described above, the positioning plate 31 has flexibility (spring characteristics), and the positioning pin 32 is fixed to the end surface 21*f* of the housing 21. However, it is not limited to such. The positioning plate 31 may be provided with a protrusion such as the positioning pin 32, and the end surface 21*f* of the housing 21 may have a positioning hole.

Figure 12:
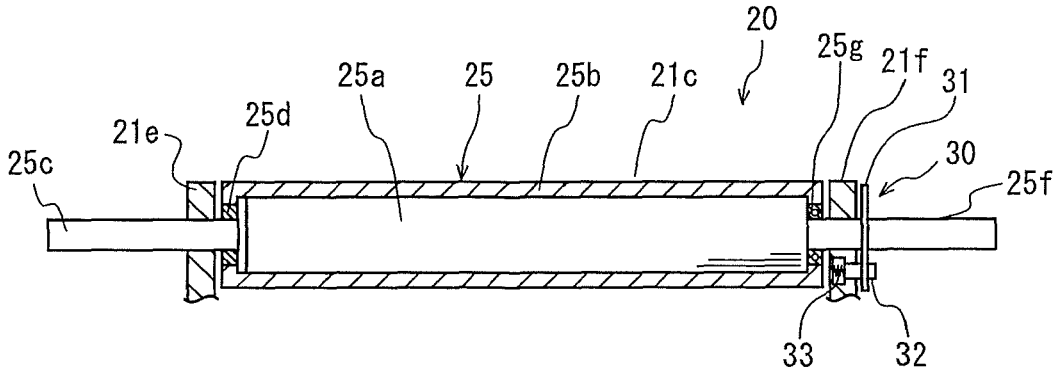
FIG. 12 is a side view showing a portion of the developing device where a different positioning member is attached.

Furthermore, as shown in FIG. 12, the positioning pin 32 may be biased toward the positioning plate 31 from the end surface 21*f* of the housing 21, by a spring 33 provided on the end surface 21*f*. In this case, the positioning plate 31 does not need to have flexibility (spring characteristics). The holding force P1, by which the positioning plate 31 is held to consequently hold the magnet roller 25*a*, is generated by the tip of the positioning pin 32 being pressed against the positioning plate 31 with use of the spring 33.

Figure 13A:
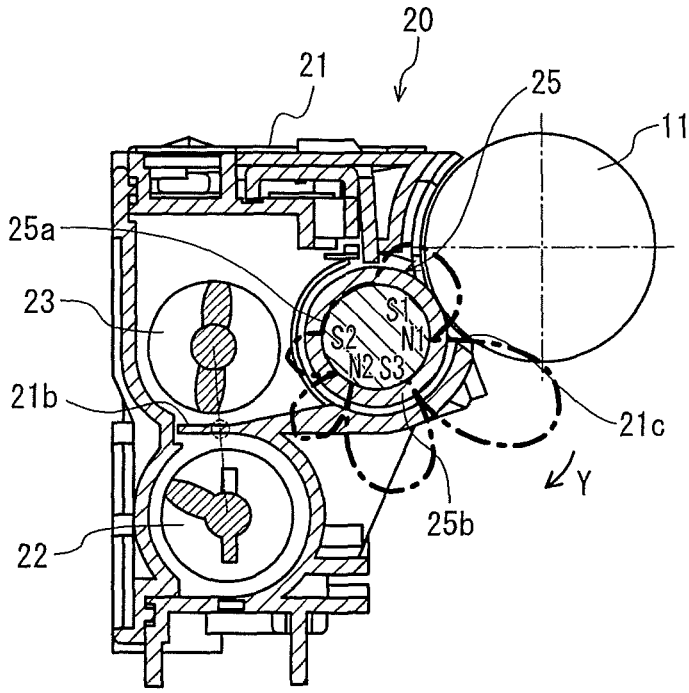
FIG. 13A is a transverse sectional view showing another example of the developing device.

Also, in the embodiment described above, when the process unit is shipped from the factory, the magnet roller 25*a* is set in the first rotational position where the third S-pole S3 faces the lower side edge 21*y* of the opening 21*c* of the housing 21. However, the magnet roller 25*a* may be held in a state (first rotational position) where the first N-pole N1 having the strongest magnetic force faces the lower side edge 21*y* of the opening 21*c* of the housing 21, as shown in FIG. 13A.

Figure 13B:
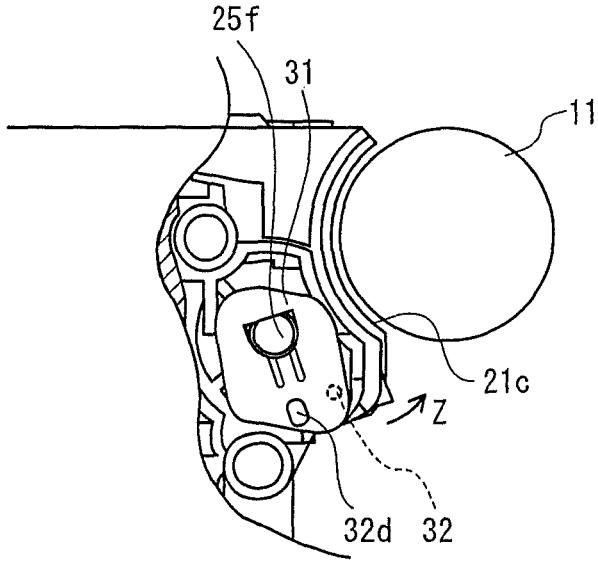
FIG. 13B is a side view of a portion of the developing device where the positioning member is attached, in the case of the example shown in FIG. 13A.

In this case, the magnet roller 25*a* is set in the first rotational position by rotating the positioning plate 31 in a direction shown by an arrow Z in FIG. 13B. In this way, the first N-pole N1 moves from the second rotational position, which faces the surface of the photosensitive drum 11 via the developing sleeve 25*b* and the opening 21*c* of the housing 21, to the first rotational position. At this time, the positioning plate 31 is rotated in a state where the tip of the positioning pin 32 is pressed against the positioning plate 31, after the positioning pin 32 is unlatched from the positioning hole 31*d*.

When the process unit is mounted in the image formation section A of the printer in the aforementioned state, the developing sleeve 25*b* is driven to rotate in an opposite direction (shown by the arrow Z in FIG. 13B) from the rotation direction when developing electrostatic latent images. Then, the positioning plate 31 is rotated by a predetermined degree, causing the positioning pin 32 to be inserted into the positioning hole 31*d* of the positioning plate 31 and latched thereto. As a result, the magnet roller 25*a* is set in the second rotational position where the first N-pole N1 is closest to the surface of the photosensitive drum 11.

Note that the present invention is also applicable in a case where only the developing device 20 can be removably mounted in the image formation section A. Also, the image forming apparatus according to the present invention is not limited to the tandem-type color digital printer, and may be a printer for forming monochrome images. Furthermore, the present invention is applicable to a copier, a FAX, an MFP (Multiple Function Peripheral), or the like that is capable of forming color or monochrome images.

As described above, the present invention relates to a developing device for developing an electrostatic latent image formed on the outer circumferential surface of an image carrier (i.e., photosensitive drum). According to the present invention, a magnet roller is in the state of preventing toner from leaking out from the developing device, before image formation (e.g., during transportation). Then, at the start of image formation, the magnet roller is fixed to a predetermined position by the rotation of a developing sleeve encasing the magnet roller.

Also, the present invention provides a process unit comprising: the aforementioned developing device; and an image carrier that faces the developing sleeve through the opening of the housing.

Furthermore, the present invention provides an image formation apparatus comprising the aforementioned process unit.

In the developing device according to the present invention, when the magnet roller is in the first rotational position, one of the first and the second magnetic poles faces the lower edge (i.e., downstream edge) of the opening in the housing, which is located downstream in the rotation direction of the developing sleeve (i.e., in the transfer direction of the two-component developer on the developing sleeve) when developing the electrostatic latent image. With this structure, the carriers in the two-component developer are attracted to the one of the first and the second magnetic poles. This achieves an advantageous effect where the carriers are retained in the gap between the lower edge of the opening of the housing and the developing sleeve, preventing the toner in the housing from leaking out through the opening.

Furthermore, when the developing sleeve is driven to rotate in the state where the developing device is mounted in the image forming apparatus, the magnet roller in the first rotational position is rotated together with the rotation of the developing sleeve. As a result, the magnet roller is rotated to be positioned at the second rotational position in which the first magnetic pole is located closest to the photosensitive drum. Afterward, the developing sleeve is rotated while the magnet roller is fixed at the second rotational position. This makes it possible to appropriately perform developing operations.

As described above, when the developing device is mounted in the image forming apparatus, the magnet roller is rotated together with the rotation of the developing sleeve. This eliminates the necessity of preparing a special mechanism for rotating the magnet roller. Therefore, the structure according to the present invention does not impair cost efficiency, and prevents the image forming apparatus from increasing in size.

Preferably, the positioning member holds the magnet roller in the first rotational position until the developing sleeve starts rotating.

Also, it is preferable that the housing includes a first latch part, the positioning member includes: a second latch part; a plate that is attached to the magnet roller to be integrated therewith; and a bias member, one of the first and the second latch parts is a protrusion and the other is a hole, the protrusion being latched by the hole to hold the magnet roller in the second rotational position, and the bias member is operable to bias one of the housing and the plate that has the hole, so that when the protrusion is unlatched from the hole, the protrusion is pressed against a surface of the one of the housing and the plate that has the hole so as to hold the magnet roller in the first rotational position.

Preferably, the plate has spring characteristics, and is integrated with the bias member to bias the one of the housing and the plate that has the hole.

It is preferable that the protrusion is a pin and is capable of sliding against one of the plate and the housing that has the hole, and the bias member is a spring that biases the pin.

Preferably, the developing device further comprises a regulation member that is operable to regulate an amount of the two-component developer transferred by the rotation of the developing sleeve, and that is arranged at the upstream edge of the opening.

It is preferable that the second magnetic pole is adjacent to the first magnetic pole, and is arranged farther downstream than the first magnetic pole in a rotation direction of the developing sleeve when developing the electrostatic latent image, and when the second magnetic pole faces the downstream edge of the opening, the magnet roller is rotated in a same direction as the rotation direction of the developing sleeve, so that the magnet roller moves from the first rotational position to the second rotational position.

Preferably, when the first magnetic pole faces the downstream edge of the opening, the magnet roller is rotated in an opposite direction from in a rotation direction of the developing sleeve when developing the electrostatic latent image, so that the magnet roller moves from the first rotational position to the second rotational position.

Although the present invention has been fully described by way of examples with reference to the accompanying drawings, it is to be noted that various changes and modifications will be apparent to those skilled in the art. Therefore, unless such changes and modifications depart from the scope of the present invention, they should be constructed as being included therein.

What is claimed is:

1. A developing device for developing an electrostatic latent image formed on an outer circumferential surface of an image carrier, the developing device comprising:

a housing that contains therein a two-component developer and has an opening facing the image carrier;

a developing sleeve that is rotatably held in the housing and partially exposed from the opening of the housing to face the image carrier, with (i) a gap between an outer circumferential surface of the developing sleeve and an upstream edge of the opening and (ii) a gap between the outer circumferential surface thereof and a downstream edge of the opening, the upstream and the downstream edges of the opening respectively being an edge located upstream and an edge located downstream in a transfer direction of the two-component developer on the developing sleeve that rotates when developing the electrostatic latent image;

a magnet roller that is arranged inside the developing sleeve and has a plurality of magnetic poles arranged along a circumferential direction of the magnet roller, the plurality of magnetic poles including first and second magnetic poles, the first magnetic pole having a strongest magnetic force among the plurality of magnetic poles, the second magnetic pole having a magnetic force equal to or larger than a predetermined value and less than the magnetic force of the first magnetic pole; and a positioning member operationally connected to the magnet roller so that: (i) the magnet roller automatically rotates by virtue of rotation of the developing sleeve and rotates together with the developing sleeve when the magnet roller is in a first rotational position, and (ii) rotation of the magnet roller is inhibited when the magnet roller is in a second rotational position, the first rotational position being a position where one of the first and the second magnetic poles faces the downstream edge of the opening, the second rotational position being a position where the first magnetic pole is closest to the image carrier.

2. A developing device for developing an electrostatic latent image formed on an outer circumferential surface of an image carrier, the developing device comprising:

a housing that contains therein a two-component developer and has an opening facing the image carrier;

a developing sleeve that is rotatably held in the housing and partially exposed from the opening of the housing to face the image carrier, with (i) a gap between an outer circumferential surface of the developing sleeve and an upstream edge of the opening and (ii) a gap between the outer circumferential surface thereof and a downstream edge of the opening, the upstream and the downstream edges of the opening respectively being an edge located upstream and an edge located downstream in a transfer direction of the two-component developer on the developing sleeve that rotates when developing the electrostatic latent image;

a magnet roller that is arranged inside the developing sleeve and has a plurality of magnetic poles arranged along a circumferential direction of the magnet roller, the plurality of magnetic poles including first and second magnetic poles, the first magnetic pole having a strongest magnetic force among the plurality of magnetic poles, the second magnetic pole having a magnetic force equal to or larger than a predetermined value and being different from the first magnetic pole;

a positioning member operationally connected to the magnet roller so that: (i) the magnet roller rotates by virtue of rotation of the developing sleeve and rotates together with the developing sleeve when the magnet roller is in a first rotational position, and (ii) rotation of the magnet roller is inhibited when the magnet roller is in a second rotational position, the first rotational position being a position where one of the first and the second magnetic poles faces the downstream edge of the opening, the second rotational position being a position where the first magnetic pole is closest to the image carrier; and the positioning member holds the magnet roller in the first rotational position until the developing sleeve starts rotating.

3. The developing device of claim 2, wherein the housing includes a first latch part, the positioning member includes:

a second latch part;

a plate that is attached to the magnet roller to be integrated therewith; and a bias member, one of the first and the second latch parts is a protrusion and the other is a hole, the protrusion being latched by the hole to hold the magnet roller in the second rotational position, and the bias member is operable to bias one of the housing and the plate that has the hole, so that when the protrusion is unlatched from the hole, the protrusion is pressed against a surface of the one of the housing and the plate that has the hole so as to hold the magnet roller in the first rotational position.

4. The developing device of claim 3, wherein the plate has spring characteristics, and is integrated with the bias member to bias the one of the housing and the plate that has the hole.

5. The developing device of claim 3, wherein the protrusion is a pin and is capable of sliding against one of the plate and the housing that has the hole, and the bias member is a spring that biases the pin.

6. The developing device of claim 1 further comprising a regulation member that is operable to regulate an amount of the two-component developer transferred by the rotation of the developing sleeve, and that is arranged at the upstream edge of the opening.

7. The developing device of claim 1, wherein the second magnetic pole is adjacent to the first magnetic pole, and is arranged farther downstream than the first magnetic pole in a rotation direction of the developing sleeve when developing the electrostatic latent image, and when the second magnetic pole faces the downstream edge of the opening, the magnet roller is rotated in a same direction as the rotation direction of the developing sleeve, so that the magnet roller moves from the first rotational position to the second rotational position.

8. The developing device of claim 1, wherein when the first magnetic pole faces the downstream edge of the opening, the magnet roller is rotated in an opposite direction from in a rotation direction of the developing sleeve when developing the electrostatic latent image, so that the magnet roller moves from the first rotational position to the second rotational position.

9. A process unit comprising:

an image carrier; and a developing device for developing an electrostatic latent image formed on an outer circumferential surface of the image carrier, wherein the developing device includes:

a housing that contains therein a two-component developer and has an opening facing the image carrier;

a developing sleeve that is rotatably held in the housing and partially exposed from the opening of the housing to face the image carrier, with (i) a gap between an outer circumferential surface of the developing sleeve and an upstream edge of the opening and (ii) a gap between the outer circumferential surface thereof and a downstream edge of the opening, the upstream and the downstream edges of the opening respectively being an edge located upstream and an edge located downstream in a transfer direction of the two-component developer on the developing sleeve that rotates when developing the electrostatic latent image;

a magnet roller that is arranged inside the developing sleeve and has a plurality of magnetic poles arranged along a circumferential direction of the magnet roller, the plurality of magnetic poles including first and second magnetic poles, the first magnetic pole having a strongest magnetic force among the plurality of magnetic poles, the second magnetic pole having a magnetic force equal to or larger than a predetermined value and less than the magnetic force of the first magnetic pole; and a positioning member operationally connected to the magnet roller so that: (i) the magnet roller automatically rotates by virtue of rotation of the developing sleeve and rotates together with the developing sleeve when the magnet roller is in a first rotational position, and (ii) rotation of the magnet roller is inhibited when the magnet roller is in a second rotational position, the first rotational position being a position where one of the first and the second magnetic poles faces the downstream edge of the opening, the second rotational position being a position where the first magnetic pole is closest to the image carrier, and the image carrier faces the developing sleeve through the opening of the housing.

10. A process unit comprising:

an image carrier; and a developing device for developing an electrostatic latent image formed on an outer circumferential surface of the image carrier, wherein the developing device includes:

a housing that contains therein a two-component developer and has an opening facing the image carrier;

a developing sleeve that is rotatably held in the housing and partially exposed from the opening of the housing to face the image carrier, with (i) a gap between an outer circumferential surface of the developing sleeve and an upstream edge of the opening and (ii) a gap between the outer circumferential surface thereof and a downstream edge of the opening, the upstream and the downstream edges of the opening respectively being an edge located upstream and an edge located downstream in a transfer direction of the two-component developer on the developing sleeve that rotates when developing the electrostatic latent image;

a magnet roller that is arranged inside the developing sleeve and has a plurality of magnetic poles arranged along a circumferential direction of the magnet roller, the plurality of magnetic poles including first and second magnetic poles, the first magnetic pole having a strongest magnetic force among the plurality of magnetic poles, the second magnetic pole having a magnetic force equal to or larger than a predetermined value and being different from the first magnetic pole;

a positioning member operationally connected to the magnet roller so that: (i) the magnet roller rotates by virtue of rotation of the developing sleeve and rotates together with the developing sleeve when the magnet roller is in a first rotational position, and (ii) rotation of the magnet roller is inhibited when the magnet roller is in a second rotational position, the first rotational position being a position where one of the first and the second magnetic poles faces the downstream edge of the opening, the second rotational position being a position where the first magnetic pole is closest to the image carrier;

the image carrier faces the developing sleeve through the opening of the housing; and the positioning member holds the magnet roller in the first rotational position until the developing sleeve starts rotating.

11. The process unit of claim 10, wherein the housing includes a first latch part, the positioning member includes:

a second latch part;

a plate that is attached to the magnet roller to be integrated therewith; and a bias member, one of the first and the second latch parts is a protrusion and the other is a hole, the protrusion being latched by the hole to hold the magnet roller in the second rotational position, and the bias member is operable to bias one of the housing and the plate that has the hole, so that when the protrusion is unlatched from the hole, the protrusion is pressed against a surface of the one of the housing and the plate that has the hole so as to hold the magnet roller in the first rotational position.

12. The process unit of claim 11, wherein the protrusion is a pin and is capable of sliding against one of the plate and the housing that has the hole, and the bias member is a spring that biases the pin.

13. The process unit of claim 9, wherein the second magnetic pole is adjacent to the first magnetic pole, and is arranged farther downstream than the first magnetic pole in a rotation direction of the developing sleeve when developing the electrostatic latent image, and when the second magnetic pole faces the downstream edge of the opening, the magnet roller is rotated in a same direction as the rotation direction of the developing sleeve, so that the magnet roller moves from the first rotational position to the second rotational position.

14. The process unit of claim 9, wherein when the first magnetic pole faces the downstream edge of the opening, the magnet roller is rotated in an opposite direction from in a rotation direction of the developing sleeve when developing the electrostatic latent image, so that the magnet roller moves from the first rotational position to the second rotational position.

15. An image formation apparatus comprising a process unit, wherein the process unit includes:

an image carrier; and a developing device for developing an electrostatic latent image formed on an outer circumferential surface of the image carrier, wherein the developing device includes:

a housing that contains therein a two-component developer and has an opening facing the image carrier;

a developing sleeve that is rotatably held in the housing and partially exposed from the opening of the housing to face the image carrier, with (i) a gap between an outer circumferential surface of the developing sleeve and an upstream edge of the opening and (ii) a gap between the outer circumferential surface thereof and a downstream edge of the opening, the upstream and the downstream edges of the opening respectively being an edge located upstream and an edge located downstream in a transfer direction of the two-component developer on the developing sleeve that rotates when developing the electrostatic latent image;

a magnet roller that is arranged inside the developing sleeve and has a plurality of magnetic poles arranged along a circumferential direction of the magnet roller, the plurality of magnetic poles including first and second magnetic poles, the first magnetic pole having a strongest magnetic force among the plurality of magnetic poles, the second magnetic pole having a magnetic force equal to or larger than a predetermined value and less than the magnetic force of the first magnetic pole; and a positioning member operationally connected to the magnet roller so that: (i) the magnet roller automatically rotates by virtue of rotation of the developing sleeve and rotates together with the developing sleeve when the magnet roller is in a first rotational position, and (ii) rotation of the magnet roller is inhibited when the magnet roller is in a second rotational position, the first rotational position being a position where one of the first and the second magnetic poles faces the downstream edge of the opening, the second rotational position being a position where the first magnetic pole is closest to the image carrier, and the image carrier faces the developing sleeve through the opening of the housing.

16. An image formation apparatus comprising a process unit, wherein the process unit includes:

an image carrier; and a developing device for developing an electrostatic latent image formed on an outer circumferential surface of the image carrier, wherein the developing device includes:

a housing that contains therein a two-component developer and has an opening facing the image carrier;

a developing sleeve that is rotatably held in the housing and partially exposed from the opening of the housing to face the image carrier, with (i) a gap between an outer circumferential surface of the developing sleeve and an upstream edge of the opening and (ii) a gap between the outer circumferential surface thereof and a downstream edge of the opening, the upstream and the downstream edges of the opening respectively being an edge located upstream and an edge located downstream in a transfer direction of the two-component developer on the developing sleeve that rotates when developing the electrostatic latent image;

a magnet roller that is arranged inside the developing sleeve and has a plurality of magnetic poles arranged along a circumferential direction of the magnet roller, the plurality of magnetic poles including first and second magnetic poles, the first magnetic pole having a strongest magnetic force among the plurality of magnetic poles, the second magnetic pole having a magnetic force equal to or larger than a predetermined value and being different from the first magnetic pole;

a positioning member operationally connected to the magnet roller so that: (i) the magnet roller rotates by virtue of rotation of the developing sleeve and rotates together with the developing sleeve when the magnet roller is in a first rotational position, (ii) rotation of the magnet roller is inhibited when the magnet roller is in a second rotational position, the first rotational position being a position where one of the first and the second magnetic poles faces the downstream edge of the opening, the second rotational position being a position where the first magnetic pole is closest to the image carrier;

the image carrier faces the developing sleeve through the opening of the housing; and the positioning member holds the magnet roller in the first rotational position until the developing sleeve starts rotating.

17. The image formation apparatus of claim 16, wherein the housing includes a first latch part, the positioning member includes:

a second latch part;

a plate that is attached to the magnet roller to be integrated therewith; and a bias member, one of the first and the second latch parts is a protrusion and the other is a hole, the protrusion being latched by the hole to hold the magnet roller in the second rotational position, and the bias member is operable to bias one of the housing and the plate that has the hole, so that when the protrusion is unlatched from the hole, the protrusion is pressed against a surface of the one of the housing and the plate that has the hole so as to hold the magnet roller in the first rotational position.

18. The image formation apparatus of claim 17, wherein the protrusion is a pin and is capable of sliding against one of the plate and the housing that has the hole, and the bias member is a spring that biases the pin.

19. The image formation apparatus of claim 15, wherein the second magnetic pole is adjacent to the first magnetic pole, and is arranged farther downstream than the first magnetic pole in a rotation direction of the developing sleeve when developing the electrostatic latent image, and when the second magnetic pole faces the downstream edge of the opening, the magnet roller is rotated in a same direction as the rotation direction of the developing sleeve, so that the magnet roller moves from the first rotational position to the second rotational position.

20. The image formation apparatus of claim 15, wherein when the first magnetic pole faces the downstream edge of the opening, the magnet roller is rotated in an opposite direction from in a rotation direction of the developing sleeve when developing the electrostatic latent image, so that the magnet roller moves from the first rotational position to the second rotational position.

* * * * *